US008834137B2

(12) United States Patent
Sworske et al.

(10) Patent No.: US 8,834,137 B2
(45) Date of Patent: Sep. 16, 2014

(54) PRIMER BULB

(75) Inventors: Paul Andrew Sworske, Allenton, WI (US); Michael Joseph Holz, West Bond, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 351 days.

(21) Appl. No.: 13/087,585

(22) Filed: Apr. 15, 2011

(65) Prior Publication Data

US 2011/0253237 A1 Oct. 20, 2011

Related U.S. Application Data

(60) Provisional application No. 61/325,097, filed on Apr. 16, 2010.

(51) Int. Cl.
*F04B 17/00* (2006.01)
*F02M 37/16* (2006.01)
*F04B 9/14* (2006.01)

(52) U.S. Cl.
CPC . *F04B 9/14* (2013.01); *F02M 37/16* (2013.01)
USPC ..... 417/416; 417/417; 417/415; 137/565.25

(58) Field of Classification Search
CPC ..... F04B 17/046; F04B 9/14
USPC ..... 417/523, 534, 555.1, 258, 469, 417/415–417, 410.1; 137/565.25; 123/179.11
See application file for complete search history.

(56) References Cited

U.S. PATENT DOCUMENTS

| | | | | | |
|---|---|---|---|---|---|
| 817,538 | A | * | 4/1906 | Wixon | 417/258 |
| 1,116,823 | A | | 11/1914 | Mathers | |
| 1,187,977 | A | | 6/1916 | Demers | |
| 1,330,266 | A | * | 2/1920 | Holstein | 417/258 |
| 1,365,824 | A | | 1/1921 | Goldberg | |
| 1,414,283 | A | * | 4/1922 | Jewell | 417/262 |
| 3,803,988 | A | | 4/1974 | Orr | |
| 3,884,125 | A | | 5/1975 | Massie | |
| 3,983,857 | A | | 10/1976 | O'Connor | |
| 4,012,174 | A | | 3/1977 | Seibel et al. | |
| 4,102,610 | A | | 7/1978 | Taboada et al. | |
| 4,231,722 | A | * | 11/1980 | Teichmann | 417/418 |
| 4,465,439 | A | * | 8/1984 | Seino | 417/417 |
| 5,201,639 | A | | 4/1993 | Reineck | |

(Continued)

FOREIGN PATENT DOCUMENTS

JP 5126035 5/1993

*Primary Examiner* — Charles Freay
*Assistant Examiner* — Christopher Bobish
(74) *Attorney, Agent, or Firm* — Michael Best & Friedrich LLP

(57) ABSTRACT

A pump includes a substantially tubular housing having an inlet end and an outlet end and defining a central axis and a chamber within the body portion, and a movable valve assembly slidably received within the housing for movement in the direction of the central axis. The pump also includes a handle assembly slidably disposed at least partially around an outer circumference of the housing for movement in the direction of the central axis, the handle assembly being substantially annular ring-shaped, and the handle assembly including a grip engageable by a hand of an operator for manually sliding the handle assembly, the handle assembly being coupled to the movable valve assembly, manual movement of the handle assembly along the central axis causing corresponding movement on the movable valve assembly along the central axis.

32 Claims, 6 Drawing Sheets

(56) References Cited

U.S. PATENT DOCUMENTS

| | | | | |
|---|---|---|---|---|
| 5,501,581 | A | 3/1996 | Han | |
| 5,970,935 | A | 10/1999 | Harvey et al. | |
| 6,132,189 | A * | 10/2000 | Ward | 417/521 |
| 6,851,938 | B2 | 2/2005 | Ding et al. | |
| 2006/0067842 | A1 * | 3/2006 | Meucci | 417/417 |
| 2007/0217930 | A1 | 9/2007 | Chiu et al. | |
| 2009/0199806 | A1 | 8/2009 | Brown et al. | |

* cited by examiner

PRIMER BULB

RELATED APPLICATION

The present application claims priority to U.S. Provisional Patent Application No. 61/325,097, filed Apr. 16, 2010, the entire contents of which are hereby incorporated by reference.

SUMMARY

The present invention relates to pumps and, more particularly, to a primer bulb for an engine, such as a marine engine.

An engine, such as a marine engine, may employ a rubber primer bulb type pumping device to provide initial prime to the fuel supply system. Such devices are simple rubber bulbs connected to fuel hoses and with a set of one-way valves to direct the direction of pumping when the bulb is squeezed.

In one independent aspect, a pump may generally include a substantially tubular housing having an inlet end and an outlet end and defining a central axis and a chamber within the body portion. The pump may also include a movable valve assembly slidably received within the housing for movement in the direction of the central axis, the movable valve assembly dividing the chamber into a first chamber portion and a second chamber portion, the first chamber portion and the second chamber portion having first and second volumes which vary with the position of the movable valve assembly, the movable valve assembly including a valve member operable to selectively allow fluid to flow between the first chamber portion and the second chamber portion. The pump may also include a handle assembly slidably disposed at least partially around an outer circumference of the housing for movement in the direction of the central axis, the handle assembly being substantially annular ring-shaped, and the handle assembly including a grip engageable by a hand of an operator for manually sliding the handle assembly, the handle assembly being coupled to the movable valve assembly, manual movement of the handle assembly along the central axis causing corresponding movement on the movable valve assembly along the central axis.

In another independent aspect, a pump may generally include a substantially tubular housing having an inlet end and an outlet end and defining a central axis and a chamber within the body portion. The pump may also include an inlet connector coupled to the housing and configured to be coupled to an inlet conduit and including a first outer rim projecting radially beyond an outer surface of the inlet end of the housing. The pump may also include an outlet connector coupled to the housing and configured to be coupled to an outlet conduit and including a second outer rim projecting radially beyond an outer surface of the outlet end of the housing. The pump may also include a movable valve assembly slidably received within the housing for movement in the direction of the central axis, the movable valve assembly dividing the chamber into a first chamber portion and a second chamber portion, the first chamber portion and the second chamber portion having first and second volumes that vary with the position of the movable valve assembly, the movable valve assembly including a valve member which selectively allows fluid to flow between the first chamber portion and the second chamber portion. The pump may also include a handle assembly including a grip for manually actuating the handle assembly, the handle assembly being coupled to the movable valve assembly, manual movement of the handle assembly along the central axis causing corresponding movement on the movable valve assembly along the central axis, movement of the handle assembly being limited by the first outer rim and the second outer rim of the inlet connector and the outlet connector, respectively.

In yet another independent aspect, a method of assembling a pump is provided. The method may generally include providing a substantially tubular housing having an open inlet end and an open outlet end and defining a central axis and a chamber within the body portion, providing an inlet connector having a first outer rim, and providing an outlet connector having a second outer rim, providing a movable valve assembly including a valve member. The method may also include positioning the movable valve assembly into the chamber for movement in the direction of the central axis, the movable valve assembly being operable to divide the chamber into a first chamber portion and a second chamber portion, the first chamber portion and the second chamber portion having first and second volumes that vary with the position of the movable valve assembly, the valve member selectively allowing fluid to flow between the first chamber portion and second chamber portions. The method may also include providing an annular handle assembly including a grip for manually actuating the handle assembly, sliding the handle assembly around an outer circumference of the tubular housing to slidably support the handle assembly with respect to the housing, coupling the inlet connector to the inlet end of the housing and disposing the first outer rim around an outer surface of the inlet end of the housing, and coupling the outlet connector to the outlet end of the housing and disposing the second outer rim around an outer surface of the outlet end of the housing.

DETAILED DESCRIPTION

Figure 1:
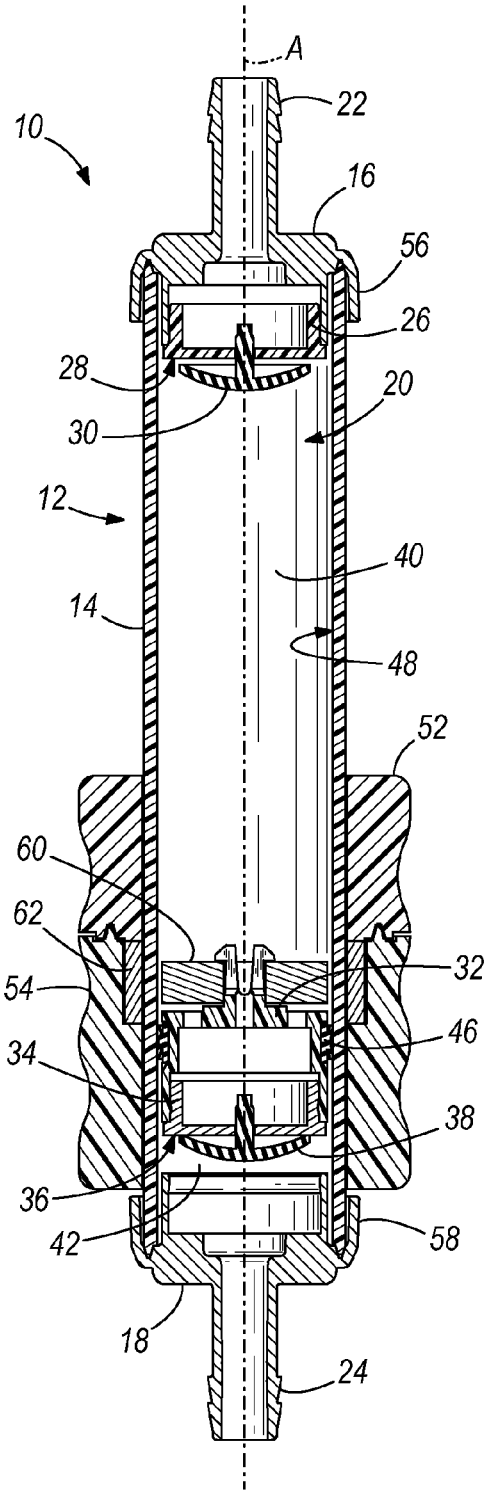
FIG. 1 is a cross-sectional view of a pump, such as a primer bulb, and illustrating the forward position

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

One construction of a pump 10, such as a primer bulb, for pumping a liquid, such as fuel, to, for example, prime an engine, is shown in FIGS. 1-6. It should be understood that, in other constructions, the pump 10 may be used to pump other liquids or fluids.

The primer bulb 10 generally includes a housing assembly 12 formed by a main housing portion or cylinder 14 and inlet and outlet end portions 16, 18 which cooperate to define a chamber 20. The main housing portion 14 defines a central axis A, or longitudinal axis. A seal arrangement (not shown)

may be provided between the cylinder 14 and the end portions 16, 18 to seal the chamber 20. In the illustrated construction, the inlet end portion 16 provides an inlet to the housing assembly 12 and is connected to a supply of liquid (not shown), such as a fuel container or tank, and the outlet end portion 18 provides an outlet from the housing assembly and is connected to the device to be supplied with liquid, such as an engine (not shown).

The inlet and outlet end portions 16, 18 includes respective inlet and outlet connectors 22, 24, such as, in the illustrated construction, a barb fitting, for connection to, for example, a conduit, hose, etc. (not shown), providing fluid communication between the fluid source and the engine. It should be understood that, in other constructions (not shown), the connectors 22, 24 may have a different shape, size, etc. for connection to a conduit, hose, etc. having a complementary construction. Also, another connecting arrangement, such as clamps, adhesive materials, etc., may provide and/or improve the connection. The connection could also be threaded.

A cap 26 is supported by the inlet end portion 16 and provides (or supports) a valve seat 28. A valve member 30, such as an umbrella valve member, is supported for selective engagement with the valve seat 28 and provides an inlet valve for the primer bulb 10. In an open position (see FIG. 1), the inlet valve member 30 is out of engagement with the valve seat 28 such that fluid can enter the chamber 20 through the inlet. In a closed position (see FIG. 2), the inlet valve member 30 engages the valve seat 28 such that fluid is prevented from flowing through the inlet.

A carrier 32 is supported for movement in the chamber 20. The carrier 32 supports a cap 34, which provides a valve seat 36, and a valve member 38, such as an umbrella valve member, is supported for selective engagement with the valve seat 36. The carrier 32 and the valve member 38 cooperate to divide the chamber 20 into a first chamber portion 40 (e.g., the upstream portion of the chamber 20 in FIGS. 1-2) and a second chamber portion 42 (e.g., the downstream portion of the chamber 20 in FIGS. 1-2). As the carrier 32 and the valve member 38 move in the chamber 20, the relative volume of the chamber portions 40, 42 changes (as illustrated in the relative differences between FIG. 1 and FIG. 2).

Figure 2:
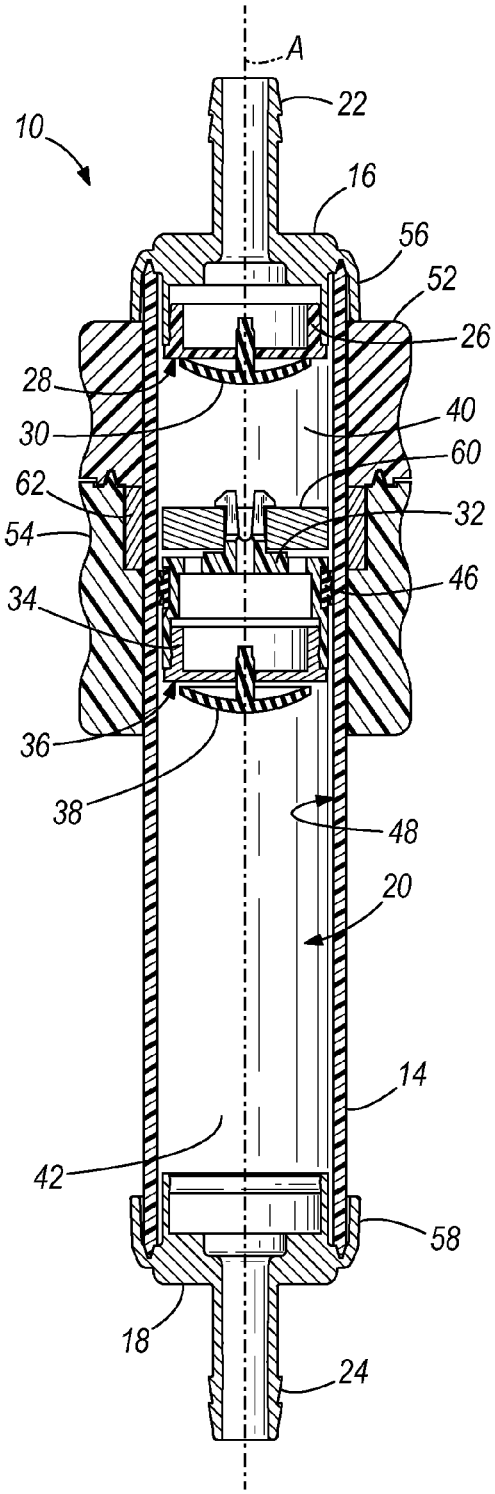
FIG. 2 is a cross-sectional view of the primer bulb shown in FIG. 1 and illustrating the rearward position.
Figure 3:
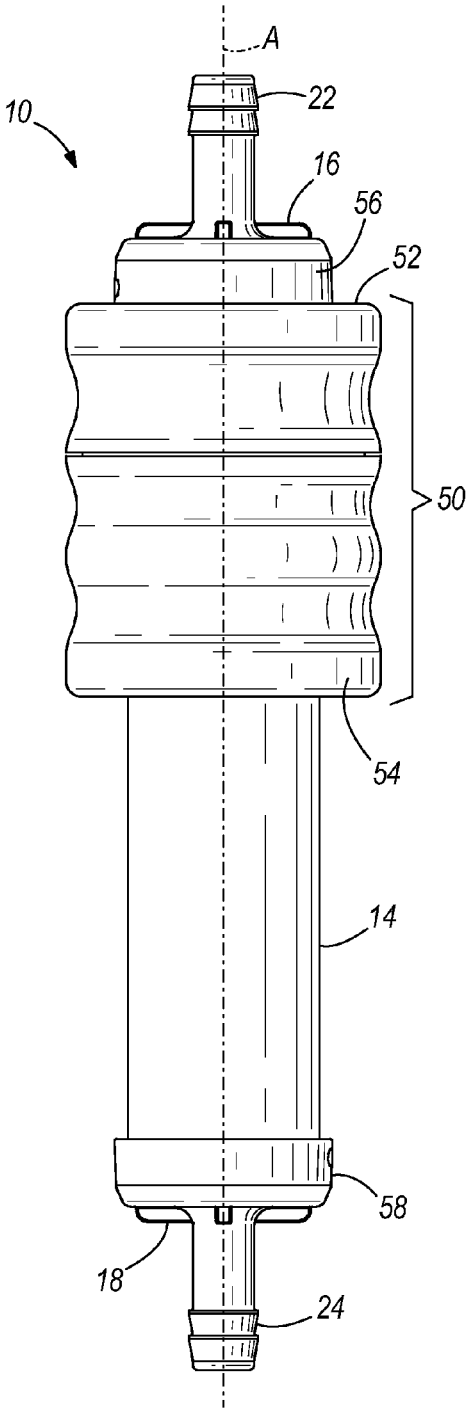
FIG. 3 is a side view of the primer bulb shown in FIG. 1.
Figure 4:
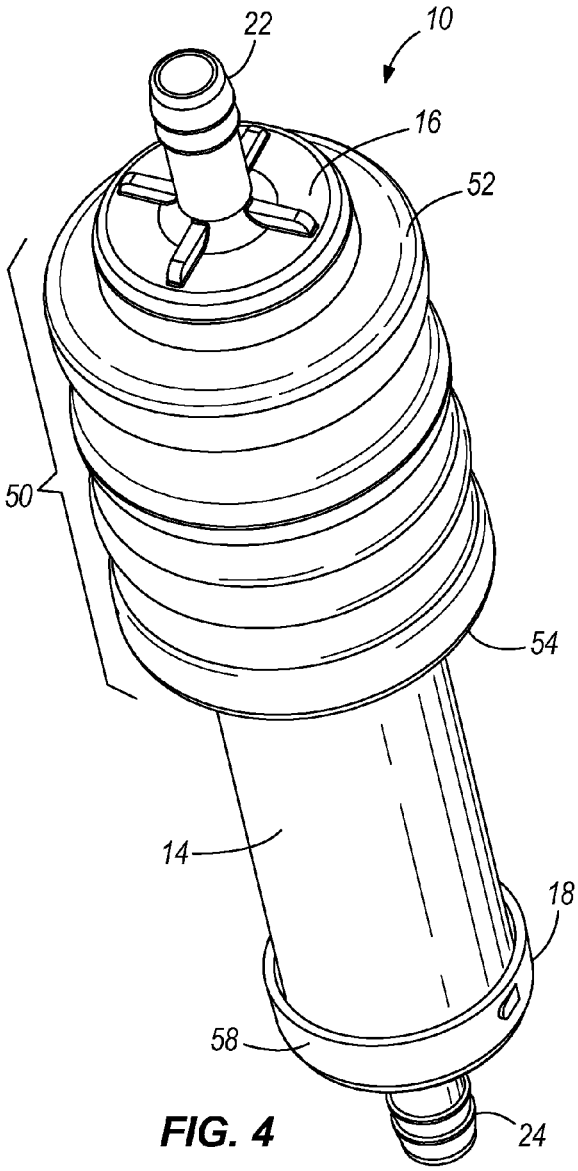
FIG. 4 is a perspective view of the primer bulb shown in FIG. 1

A seal 46 is provided between the carrier 32 and an inner surface 48 of the cylinder 10 such that flow between the chamber portions 40, 42 is provided only when the valve member 38 is in an open position (as shown in FIG. 2). In the open position (see FIG. 2), the valve member 38 is out of engagement with the valve seat 36 such that fluid can flow between the first chamber portion 40 and the second chamber portion 42 (e.g., from the first chamber portion 40 to the second chamber portion 42 during operation of the primer bulb 10, as described below). In a closed position (see FIG. 1), the valve member 38 engages the valve seat 36 such that fluid is prevented from flowing between the chamber portions 40, 42.

An actuator is provided to move the carrier 32 in the chamber 20 and to selectively open and close the valves 30, 38. In the illustrated construction, the actuator includes a handle assembly 50 formed by handle portions 52, 54. The handle portions 52, 54 are generally annular ring-shaped members which surround and are freely slidable along the cylinder 14. As shown in FIGS. 1-2, each end portion 16, 18 includes a respective outer rim 56, 58 which fits around the outer surface of the cylinder 14. The outer rims 56, 58 limit movement of the handle assembly along the cylinder 14.

The pump 10 also includes a coupling between the handle assembly 50 and the carrier 32. In the illustrated construction, the coupling includes a magnet assembly which uses magnetic forces to couple the handle assembly 50 and the carrier 32. Because, in the illustrated construction, the coupling is provided without direct contact between the handle assembly 50 and the carrier 32, an opening through the side wall of the cylinder 14 through which these components could be coupled is not required, eliminating the requirement to seal such an opening.

Figure 5:
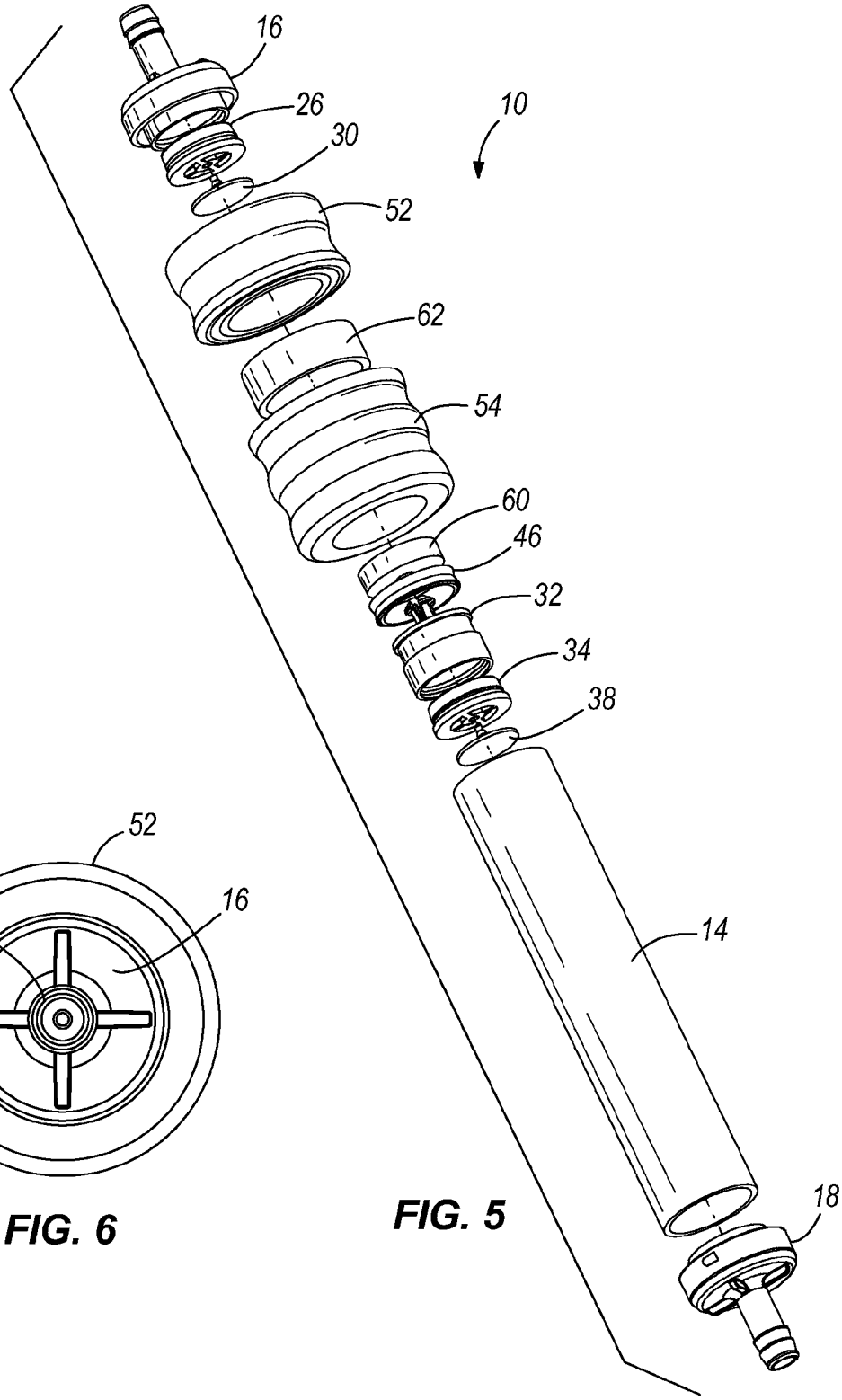
FIG. 5 is an exploded perspective view of the primer bulb shown in FIG. 1

As shown in FIGS. 1-2 and 5, the magnet assembly includes an inner magnet member 60 connected to and movable with the carrier 32 and an outer magnet member 62 supported by and movable with the handle assembly 50. In the illustrated construction, both magnet members 60, 62 are magnetically charged. It should be understood that, in other constructions, only one of the magnet members (e.g., magnet member 60) is magnetically charged, and the other magnet member (e.g., magnet member 62), while not magnetically charged, is formed of a material (e.g., as a metal sleeve) which cooperates with the magnetically-charged member to provide the coupling, e.g., a ferromagnetic material, etc. It should also be understood that, in such a construction, either magnet member 60 or 62 may be magnetically charged.

FIG. 5 illustrates assembly of the primer bulb 10. The cylinder 14 may be formed as an extruded tube, may be injection molded, etc. The carrier 32, the valve seat 36, the valve member 38, the inner magnet member 60 and the seal 46 are assembled as a unit and inserted into the cylinder 14. The outer magnet member 62 is assembled between the handle portions 52, 54, and the handle assembly 50 is slid onto the cylinder 14. The handle assembly 50 may be connected as a unit by welding such as spin welding, ultrasonic welding, hot plate welding, etc. or by using other means, such as adhesives. The connection operation captures the metal component (the outer magnet member 62) in the handle portions 52, 54.

The magnet members 60, 62 are radially aligned, i.e., positioned at about the same axial location, to provide the coupling. The inlet end piece 16, the cap 26 and the inlet valve member 30 are assembled as a unit and connected to the inlet end of the cylinder 14 (e.g., by welding, adhesive, press-fit, threading, etc.) with the outer rim 56 surrounding the inlet end of the cylinder 14. The outlet end piece 18 is connected to the outlet end of the cylinder 14 (e.g., by welding, adhesive, press-fit, threading, etc.) with the outer rim 58 surrounding the outlet end of the cylinder 14. The primer bulb 10 is thus fully assembled (as shown in FIGS. 1-4).

The primer bulb 10 is connected in the fuel supply. An inlet conduit is connected between the fuel tank and the inlet end connector 22, and an outlet conduit is connected between the outlet end connector 24 and the engine. The primer bulb 10 may then be operated to prime the engine. The primer bulb 10 may be positioned on a structure (e.g., a vehicle frame (not shown)) such that the operator is not required to support the primer bulb 10 during operation and can, therefore, operate the primer bulb 10 with one hand, as described below.

FIGS. 1-2 illustrate operation of the primer bulb 10. In an initial position (for example, shown in FIG. 2), the handle assembly 50 and the carrier 32 are in a rearward (upstream) position, and the first chamber portion 40 has relatively less volume than the second chamber portion 42. As the handle assembly 50 is moved toward the forward (downstream) position (downwardly in FIGS. 1-2), the magnetic coupling causes the carrier 32 to also move toward the forward position. This movement also causes the movable valve member 38 supported on the carrier 32 to be in the closed position (see FIG. 1). The resulting vacuum in the first chamber portion 40 causes the inlet valve member 30 to move to the open position and fuel to be drawn into and fill the first chamber portion 40.

The handle assembly 50 is movable until engagement with the outer rim 58 on the outlet end portion 18 (as shown in FIG. 1).

Once the handle assembly 50 reaches the forward position (downstream position), the handle assembly 50 is then moved toward the rearward position (upstream position; upwardly in FIGS. 1-2). Movement of the handle assembly 50 causes movement of the carrier 32 (through the magnetic coupling). This movement also causes the movable valve member 38 to be opened and the inlet valve member 30 to be closed (due to the resulting forces on the fuel in the first chamber portion 40). As a result, fuel in the first chamber portion 40 moves through the movable valve 38 to fill the second chamber portion 42. The handle assembly 50 is movable until engagement with the outer rim 56 on the inlet end portion 16 (as shown in FIG. 2).

With fuel in the second chamber portion 42, the handle assembly 50 is again moved toward the forward position. This movement also causes the movable valve member 38 supported on the carrier 32 to be in the closed position (see FIG. 1) such that fuel in the second chamber portion 42 is forced through the outlet. At the same time, the resulting vacuum in the first chamber portion 40 causes the inlet valve member 30 to move to the open position and fuel to be drawn into and fill the first chamber portion 40. The handle assembly 50 is again movable until engagement with the outer rim 58 on the outlet end portion 18 (as shown in FIG. 1). Movement of the handle assembly 50/cycling of the valves 30, 38 is continued as necessary (e.g., until the engine is primed). During normal operation of the engine, the engine can draw fuel from the tank through the primer bulb 10 (the valves 30, 38 are moved to the open position by the flow of fuel caused by the engine).

The illustrated pump priming system 10 is designed primarily for operation by a human hand (engaging and reciprocating the handle assembly 50 and thereby the carrier 32), and the handle assembly 50 is configured to be ergonomic and easily grippable (e.g., may include a resilient material coating/surface, contoured grip surface, etc.). However, the handle assembly 50 could be engaged and driven by another means (e.g., mechanical/reciprocating means).

In other constructions (not shown), a different actuator may be provided to move the carrier 32 and to thereby operate the valve(s) 30, 38. For example, an axial actuator (such as a piston rod) may penetrate through an end portion 16, 18 and be connected directly to the carrier 32 (as in a hand-operated air pump). In such a construction, a seal arrangement would be provided between the actuator and the end portion 16, 18 to allow relative movement while preventing leakage. Also, in such a construction, the associated connector 22, 24 on the end portion 16, 18 may be offset from the axis A to accommodate the actuator along the axis A (or vice versa). Similarly, the valve opening may be offset from the axis A or several valve openings may be provided around the axis A (or vice versa). The associated valve member would be selectively engageable with such opening(s).

FIGS. 7-12 illustrate another construction of a primer bulb 110. The primer bulb 110 may be similar to the primer bulb 10 described above and shown in FIGS. 1-6, and common elements have the same reference number "100".

In this illustrated construction, rather than umbrella valves 30, 38 (see FIGS. 1-2 and 5), the illustrated primer bulb 110 uses check ball valves 130, 138 (see FIGS. 6-7 and 11) which are commonly used in the marine industry. It should be understood that, in other constructions (not shown), the primer bulb 110 may use still other valve arrangements (other than the umbrella valve or the check ball valve) and/or combinations of different valve arrangements.

Figure 6:
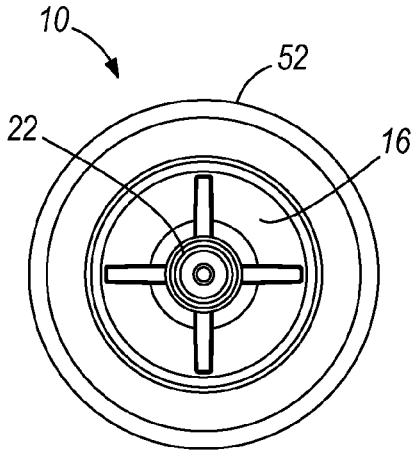
FIG. 6 is an end view of the primer bulb shown in FIG. 1.
Figure 7:
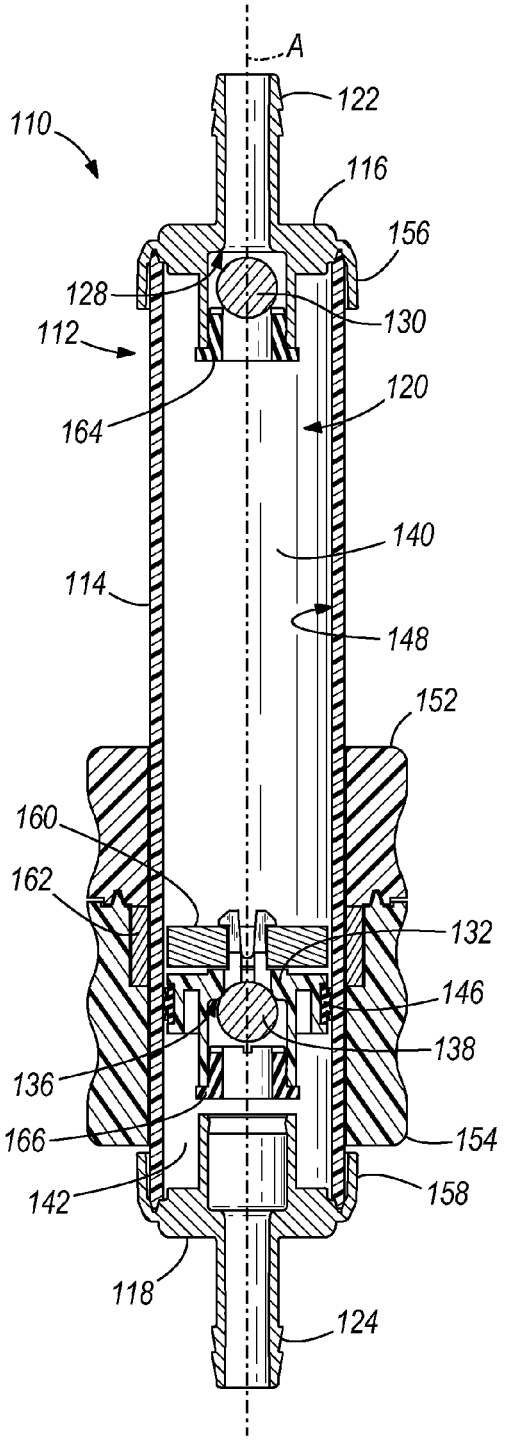
FIGS. 7-12 are views similar to FIGS. 1-6 of an alternative construction of a pump, such as a primer bulb.
Figure 8:
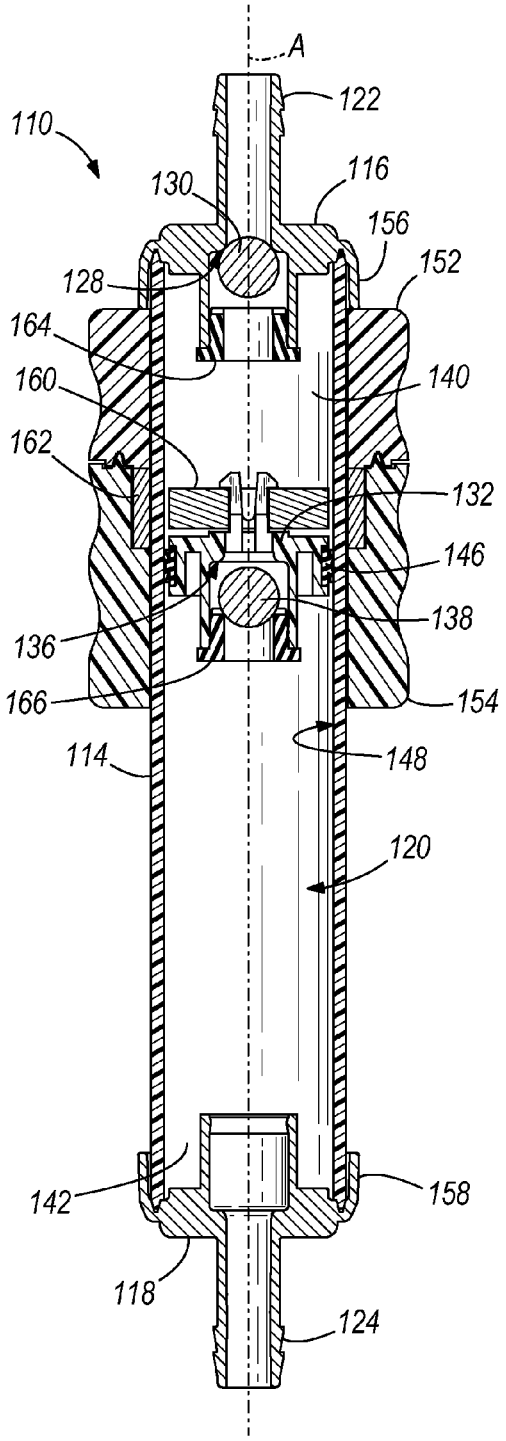
Figure 9:
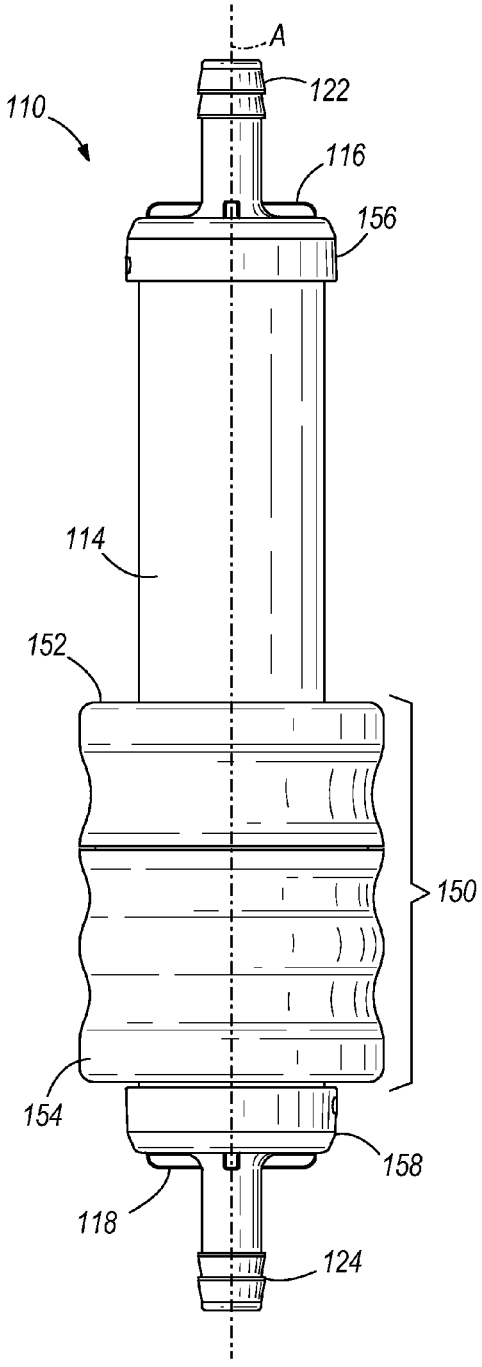
Figure 10:
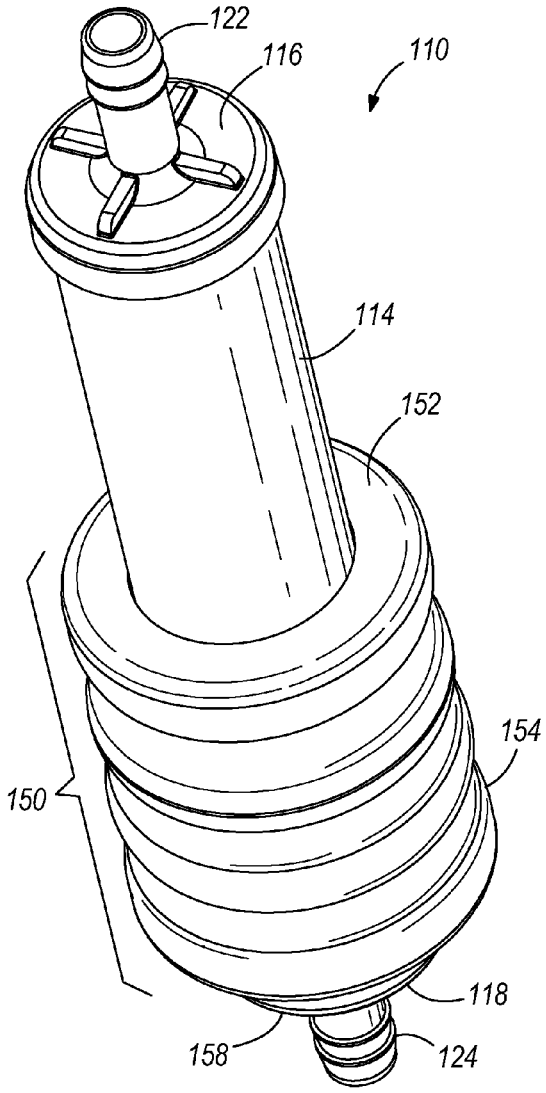
Figures 11, 12:
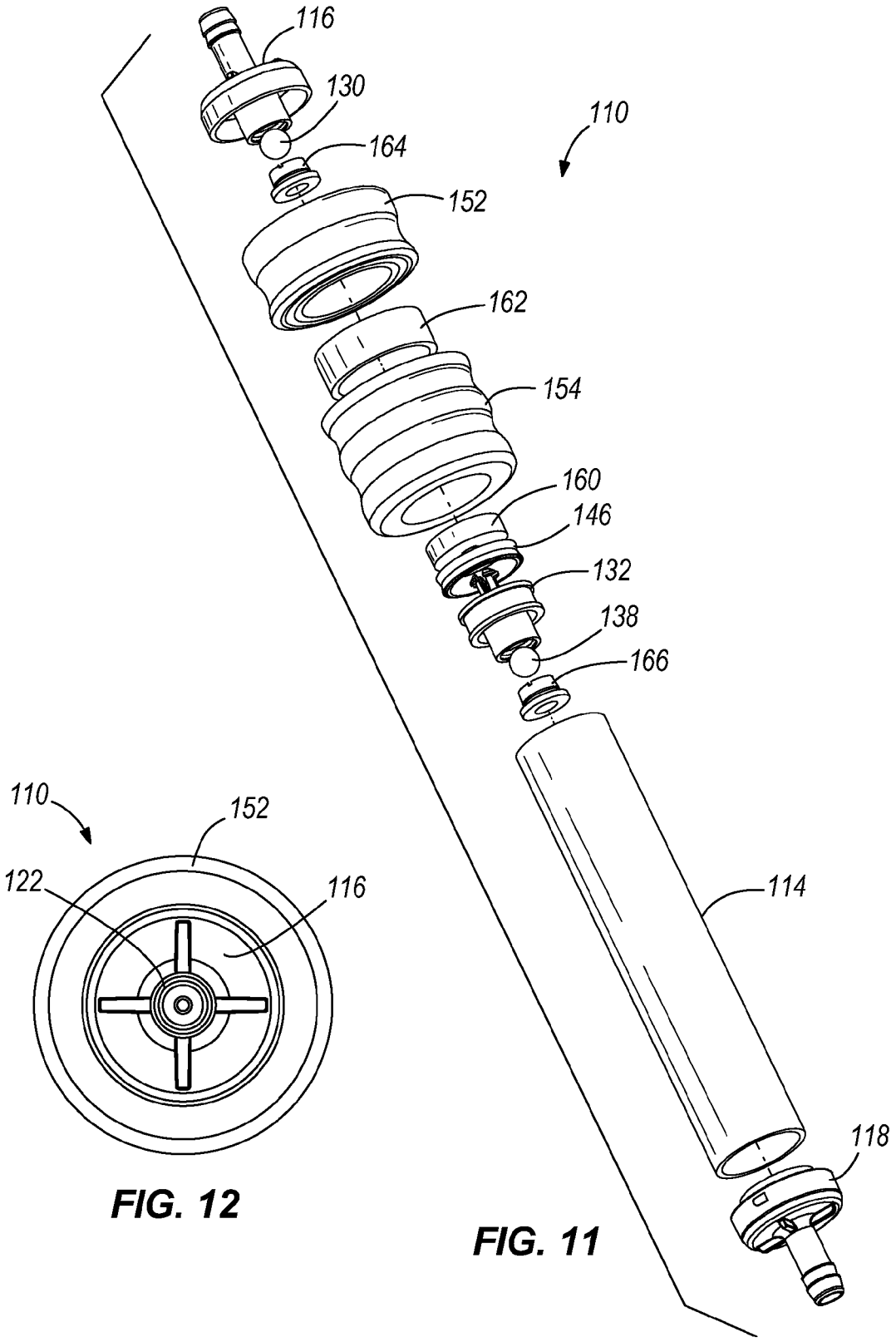

As shown in FIGS. 6-7 and 11, the inlet end piece 116 provides a valve seat 128, and an inlet check ball 130 is selectively engageable with the valve seat 128 on the end piece 116. Similarly, a molded spool 132 provides a valve seat 136, and a check ball 138 is selectively engageable with the valve seat 136 on the spool 132. A respective cap 164, 166 limits movement of each check ball 130, 138 towards the open position and may guide movement of the check ball 130, 138 between the open and closed positions. A spring member (not shown) may be provided to, for example, locate each check ball 130, 138.

In the illustrated constructions, the housing assembly 12, 112 of the primer bulb 10, 110 could be formed of materials which limit the escape of hydrocarbons. Such materials could include polybutylene terephthalate (PBT), polycarbonate, polycarbonate PBT (PC/PBT) Nylon 6, acetal(acetyl), polyethylene's with nano-sized platelets that act as a hydrocarbon barrier or any rigid polymer material that meets federal low permeation standards of less than 15 g/sq. m./day. Such a material may be a polymer with an embedded layer of carbon or other platelet particles that prevent hydrocarbon transfer. Acetal is also an exemplary material. The material used should generally be capable of being molded into components for assembly and either without seams or fitting together in such a way that there is no leakage or transfer of hydrocarbons at any seams.

While the illustrated primer bulb is intended primarily for fuel, it can also be used in any type of suction application such as the suction and delivery of oil or other fluids needing priming or delivery and, particularly, in the suction and delivery of any fluid needed to prime a fluid circuit, or to pump fluid from a reservoir to another place.

Thus, the invention provides, among other things, a pump for priming an engine. Various independent features and independent advantages of the invention may be set forth in the following claims.

What is claimed is:

1. A pump comprising:

a substantially tubular housing having an inlet end and an outlet end and defining a central axis and a chamber within a body portion;

an inlet connector coupled to the housing and configured to be coupled to an inlet conduit and including a first outer rim projecting radially beyond an outer surface of the inlet end of the housing;

an outlet connector coupled to the housing and configured to be coupled to an outlet conduit and including a second outer rim projecting radially beyond an outer surface of the outlet end of the housing; a movable valve assembly slidably received within the housing for movement in the direction of the central axis, the movable valve assembly dividing the chamber into a first chamber portion and a second chamber portion, the first chamber portion and the second chamber portion having first and second volumes which vary with the position of the movable valve assembly, the movable valve assembly including a valve member operable to selectively allow fluid to flow between the first chamber portion and the second chamber portion;

and a handle assembly slidably disposed at least partially around an outer circumference of the housing for movement in the direction of the central axis, the handle assembly being substantially annular ring-shaped, and the handle assembly including a grip engageable by a hand of an operator for manually sliding the handle assembly, the handle assembly being coupled to the movable valve assembly, manual movement of the handle assembly along the central axis causing corresponding movement of the movable valve assembly along the central axis;

wherein the movable valve assembly is spaced from at least one of the inlet connector when the handle assembly engages the inlet connector or the outlet connector when the handle assembly engages the outlet connector.

2. The pump of claim 1, wherein the handle assembly includes a first magnet member, and wherein the movable valve assembly includes a second magnet member, the first magnet member and the second magnet member being magnetically coupled to each other to couple movement of the handle assembly and the movable valve assembly.

3. The pump of claim 2, wherein the first magnet member and the second magnet member each include a magnet.

4. The pump of claim 2, wherein the first magnet member includes one of a magnet and a material attracted to a magnet, and the second magnet member includes the other of the magnet and the material attracted to the magnet.

5. The pump of claim 2, wherein the first magnet member and the second magnet member are annular-ring shaped members.

6. The pump of claim 2, wherein the first magnet member and the second magnet member are concentric and aligned radially with respect to the central axis.

7. The pump of claim 1, wherein the valve member is a one-way valve allowing fluid to flow substantially only from the inlet end toward the outlet end.

8. The pump of claim 7, wherein the one-way valve is a first one-way valve, and wherein the pump further comprises a second one-way valve disposed proximate the inlet end allowing a fluid to flow substantially only in a direction into the chamber.

9. A pump comprising:

a substantially tubular housing having an inlet end and an outlet end and defining a central axis and a chamber within the body portion;

an inlet connector coupled to the housing and configured to be coupled to an inlet conduit and including a first outer rim projecting radially beyond an outer surface of the inlet end of the housing;

an outlet connector coupled to the housing and configured to be coupled to an outlet conduit and including a second outer rim projecting radially beyond an outer surface of the outlet end of the housing;

a movable valve assembly slidably received within the housing for movement in the direction of the central axis, the movable valve assembly dividing the chamber into a first chamber portion and a second chamber portion, the first chamber portion and the second chamber portion having first and second volumes that vary with the position of the movable valve assembly, the movable valve assembly including a valve member which selectively allows fluid to flow between the first chamber portion and the second chamber portion; and a handle assembly including a grip for manually actuating the handle assembly, the handle assembly being coupled to the movable valve assembly, manual movement of the handle assembly along the central axis causing corresponding movement on the movable valve assembly along the central axis, a range of movement of the handle assembly being limited by the first outer rim and the second outer rim of the inlet connector and the outlet connector, respectively, and movement of the movable valve assembly being coupled with the movement of the handle assembly throughout the range of movement of the handle assembly.

10. The pump of claim 9, wherein the handle assembly is slidably disposed radially outside of the housing for movement in the direction of the central axis.

11. The pump of claim 9, wherein the handle assembly is substantially annular ring-shaped.

12. The pump of claim 9, wherein the handle assembly includes a first magnet member, and wherein the movable valve assembly includes a second magnet member, the first magnet member and the second magnet member being magnetically coupled to each other to couple movement of the handle assembly and the movable valve assembly.

13. The pump of claim 12, wherein the first magnet member and the second magnet member each include a magnet.

14. The pump of claim 12, wherein the first magnet member includes one of a magnet and a material attracted to a magnet, and the second magnet member includes the other of the magnet and the material attracted to the magnet.

15. The pump of claim 12, wherein the first magnet member and the second magnet member are annular-ring shaped members.

16. The pump of claim 12, wherein the first magnet member and the second magnet member are concentric and aligned radially with respect to the central axis.

17. The pump of claim 9, wherein the valve member is a one-way valve allowing fluid to flow substantially only from the inlet end toward the outlet end.

18. The pump of claim 17, wherein the one-way valve is a first one-way valve, and wherein the pump further comprises a second one-way valve disposed proximate the inlet end allowing a fluid to flow substantially only in a direction into the chamber.

19. The pump of claim 9, wherein the first outer rim is disposed around the outer surface of the inlet end of the housing, and wherein the second outer rim is disposed around the outer surface of the outlet end of the housing.

20. A method of assembling a pump, the method comprising:

providing a substantially tubular housing having an open inlet end and an open outlet end and defining a central axis and a chamber within a body portion;

providing an inlet connector having a first outer rim;

providing an outlet connector having a second outer rim;

providing a movable valve assembly including a valve member;

positioning the movable valve assembly into the chamber for movement in the direction of the central axis, the movable valve assembly being operable to divide the chamber into a first chamber portion and a second chamber portion, the first chamber portion and the second chamber portion having first and second volumes that vary with the position of the movable valve assembly, the valve member selectively allowing fluid to flow between the first chamber portion and second chamber portions;

providing an annular handle assembly including a grip for manually actuating the handle assembly;

sliding the handle assembly around an outer circumference of the tubular housing to slidably support the handle assembly with respect to the housing;

coupling the inlet connector to the inlet end of the housing and disposing the first outer rim around an outer surface of the inlet end of the housing;

coupling the outlet connector to the outlet end of the housing and disposing the second outer rim around an outer surface of the outlet end of the housing; and coupling the movable valve assembly with the handle assembly such that movement of the movable valve assembly is coupled with movement of the handle assembly throughout a range of movement of the handle assembly, the range of movement of the handle assembly being defined by the first outer rim and the second outer rim.

21. The method of claim 20, wherein providing the handle assembly includes providing an annular first magnet member, and wherein sliding the handle assembly includes sliding the first magnet member around an outer circumference of the tubular housing.

22. The method of claim 21, wherein providing a handle assembly includes providing an annular first handle portion and an annular second handle portion, and wherein the method further comprises positioning the first magnet member between the first handle portion and the second handle portion.

23. The method of claim 21, wherein providing the movable valve assembly includes providing the movable valve assembly, wherein positioning the movable valve assembly includes positioning a second magnet member into the chamber, wherein the method further comprises magnetically coupling the first magnet member to the second magnet member.

24. The method of claim 20, further comprising magnetically coupling the movable valve assembly to the handle assembly.

25. The method of claim 20, wherein coupling the inlet connector includes limiting movement of the handle assembly in a first direction, and wherein coupling the outlet connector includes limiting movement of the handle assembly in a second direction opposite the first direction.

26. The pump of claim 2, wherein a snap-fit coupling is provided between the second magnet member and a carrier.

27. The pump of claim 9, wherein the movable valve assembly is spaced from the inlet connector when the handle assembly engages the inlet connector.

28. The pump of claim 27, wherein the movable valve assembly is spaced from the outlet connector when the handle assembly engages the outlet connector.

29. The pump of claim 9, wherein the movable valve assembly is spaced from the outlet connector when the handle assembly engages the outlet connector.

30. The method of claim 20, wherein coupling the movable valve assembly with the handle assembly includes spacing the movable valve assembly from the inlet connector when the handle assembly engages the inlet connector.

31. The method of claim 30, wherein coupling the movable valve assembly with the handle assembly further includes spacing the movable valve assembly from the outlet connector when the handle assembly engages the outlet connector.

32. The method of claim 20, wherein coupling the movable valve assembly with the handle assembly includes spacing the movable valve assembly from the outlet connector when the handle assembly engages the outlet connector.

* * * * *

UNITED STATES PATENT AND TRADEMARK OFFICE

CERTIFICATE OF CORRECTION

PATENT NO. : 8,834,137 B2
APPLICATION NO. : 13/087585
DATED : September 16, 2014
INVENTOR(S) : Paul Andrew Sworske et al.

It is certified that error appears in the above-identified patent and that said Letters Patent is hereby corrected as shown below:

On the title page under item (75), line 2, "Inventors" replace the city "West Bond" with the city --West Bend--

Signed and Sealed this
Twentieth Day of January, 2015

Michelle K. Lee

Michelle K. Lee
*Deputy Director of the United States Patent and Trademark Office*